US005988085A

United States Patent [19]

Märtz

[11] Patent Number: 5,988,085

[45] Date of Patent: Nov. 23, 1999

[54] METHOD AND DEVICE FOR PRODUCING A TEXTILE HOLLOW BODY

[75] Inventor: Josef Märtz, Eching, Germany

[73] Assignee: Johann Berger, Germany

[21] Appl. No.: 09/011,403

[22] PCT Filed: Jan. 19, 1996

[86] PCT No.: PCT/EP96/00221

§ 371 Date: Jan. 28, 1998

§ 102(e) Date: Jan. 28, 1998

[87] PCT Pub. No.: WO97/05317

PCT Pub. Date: Feb. 13, 1997

[30] Foreign Application Priority Data

Jul. 28, 1995 [DE] Germany ..... 195 27 620

[51] Int. Cl.[6] ..... D05B 13/00; B60R 21/16

[52] U.S. Cl. ..... 112/470.13; 112/475.08; 280/728.1

[58] Field of Search ..... 112/10, 470.27, 112/470.12, 470.13, 470.35, 155, 217.2, 475.04; 280/728.2, 743.1, 728.7, 728.1

[56] References Cited

U.S. PATENT DOCUMENTS

| | | | |
|---|---|---|---|
| 3,661,684 | 5/1972 | Rallis et al. . | |
| 4,957,054 | 9/1990 | Sakuma et al. | 112/470.13 X |
| 4,989,525 | 2/1991 | Portilla . | |
| 5,222,932 | 6/1993 | Fontecchio | 112/475.08 X |
| 5,313,897 | 5/1994 | Katamine et al. | 112/470.13 |
| 5,379,708 | 1/1995 | Moll et al. | 112/470.17 |
| 5,381,743 | 1/1995 | Moll | 112/470.13 |
| 5,544,602 | 8/1996 | Kawasaki | 112/470.09 |
| 5,727,488 | 3/1998 | Moll | 112/470.14 |

FOREIGN PATENT DOCUMENTS

| | | |
|---|---|---|
| 1660811 | 5/1971 | Germany . |
| WO-A-9213986 | 8/1992 | WIPO . |
| WO-A-9304228 | 3/1993 | WIPO . |

*Primary Examiner*—Ismael Izaguirre
*Attorney, Agent, or Firm*—Nixon & Vanderhye

[57] ABSTRACT

The invention concerns an automatic device and method for producing a hollow body from blanks obtained from a web of material, in particular, a textile material. The hollow body is intended to be used for an airbag or as a cover for a seat or cushion. The device includes a main part (16) in the form of a plate which is self-enclosed in a ring-like manner, two side plates (18, 19) matching the sides of the main part (16), and one or two sewing devices (48, 59). Suction openings (24) connecting to a suction device can be used for securing the blanks to the inner walls of the main part and the side plates, or the blanks can be drawn in electrostatically. A moving device guides the two side plates (18, 19) from the exterior into a position inside the two inner edges (32) of the main part (16) and back out again after the blanks have been sewn. Two guides per automatic sewing device (48,49) can be provided in the vicinity of the edges of the main part or of the side plates.

17 Claims, 4 Drawing Sheets

METHOD AND DEVICE FOR PRODUCING A TEXTILE HOLLOW BODY

BACKGROUND OF THE INVENTION

1. Field of the Invention

The present invention relates to an apparatus for fabricating a hollow body from blanks, obtained from at least one web of material, particularly of a textile material, as well as to a method of fabricating the hollow body by making use of the apparatus. Hollow bodies of this kind are required for the fabrication of air bags, but also for seat or cushion covers. Instead of textile material plastics films may also be employed.

2. Description of the Related Art

Fabricating air bag hollow bodies by stitching together blanks from one or more webs of material is known. Stitching together the blanks is problematic. The shape of the blanks depends on the desired shape of the air bag hollow body. In most cases blank contours materialize which cannot be simply stitched together; the outer shapes of the blanks are mismatched so that they can not simply be placed one on the other in a single plane. Thus, instead, it is often necessary for the stitcher to register the blanks together piece by piece during the stitching procedure. As a result a seam materializes as a kind of three-dimensional configuration. On the one hand this work is very time-consuming and, on the other, it results in a relatively large amount of waste since it is not always the case that the marks on the edges of the blanks actually belonging together are also in reality stitched together. Displacements occur and the fabricated air bag hollow body needs to be eliminated as scrap. The case is similar as regards seat covers having complicated shapes.

SUMMARY OF THE INVENTION

In accordance with the present invention, an apparatus is defined which automates bringing the blanks together. This is done by making use of a main part of the apparatus in the form of a ring-like, self-contained plate, two side plates matching the sides of the main part, as well as one or two stitchers. For firmly holding the blanks at the inner walls of the main part and of the side plates suction orifices may serve which are in connection with a suction device. Instead of this the blanks may also be sucked into place electrostatically. Automatic stitchers may run around the rims of the side plates and of the main part. Instead of this a sewing machine may be provided, with respect to which the main part is turned with one or two side plates. The sewing machine may be horizonatally movable.

To fabricate a hollow body a blank is sucked into place at the inner wall of the main part. In addition, one blank each is sucked into place at the inner walls of the two side plates. After the main part and the side plates have been brought together seam allowances covering each other protrude from the three blanks. These seam allowances are then stitched to each other by the automatic stitchers or the sewing machine. On power OFF of the stitchers and after having retracted a side plate from the main part the finish-stitched hollow body can be extracted.

For guiding the side plates and the main part together and apart an automatic movement device may serve. This, the stitchers or the sewing machine and the suction devices may be coupled to each other for the necessary function sequence.

For registering the blanks, marks, holes or sections serving adjustment on the rims of the side plates and of the main part as well as on the edges of the blanks may be provided. As a result of this a very accurate register by hand is made possible. However, the blanks may also be taken from a container each and registered with sufficient accuracy by machine action.

One automatic stitcher or one such device for each side may be guided around each of the two rims of the main part and of the side plates on one robotic arm (each). The other end of the robotic arm may be attached fixedly located or in the case of a portal robot may be guided on rails e.g. horizontally and perpendicularly. Instead of this a robotic device may be made to run around the main part in a fixedly located guide as a kind of circular ring, i.e. like a gyro-wheel.

BRIEF DESCRIPTION OF THE DRAWINGS

Example embodiments incorporating further features of the invention will now be described with reference to the drawings in which.

DETAILED DESCRIPTION OF THE INVENTION

The starting point is a web of material which may consist preferably of a man-made fiber textile material, but may also consist of some other material e.g. plastics film. For fabricating an air bag hollow body blanks are produced from one or two webs of material differing in width, namely for a relatively long main part and two side parts for each hollow body. Blanking is done in the known way by stamping, by laser cutting or by ultrasonic cutting. On all or some of the blanks reinforcements, catch tapes and the like may be applied in the known way.

In the following example embodiments blanks particularly of a textile material are referred to which are stitched to each other to form an air bag hollow body which is not meant to exclude that blanks of some other material may also be connected to each other in some other way, e.g. by bonding or fusing, and that the hollow bodies serve other purposes, e.g. as seat or cushion coverings.

Figure 1:
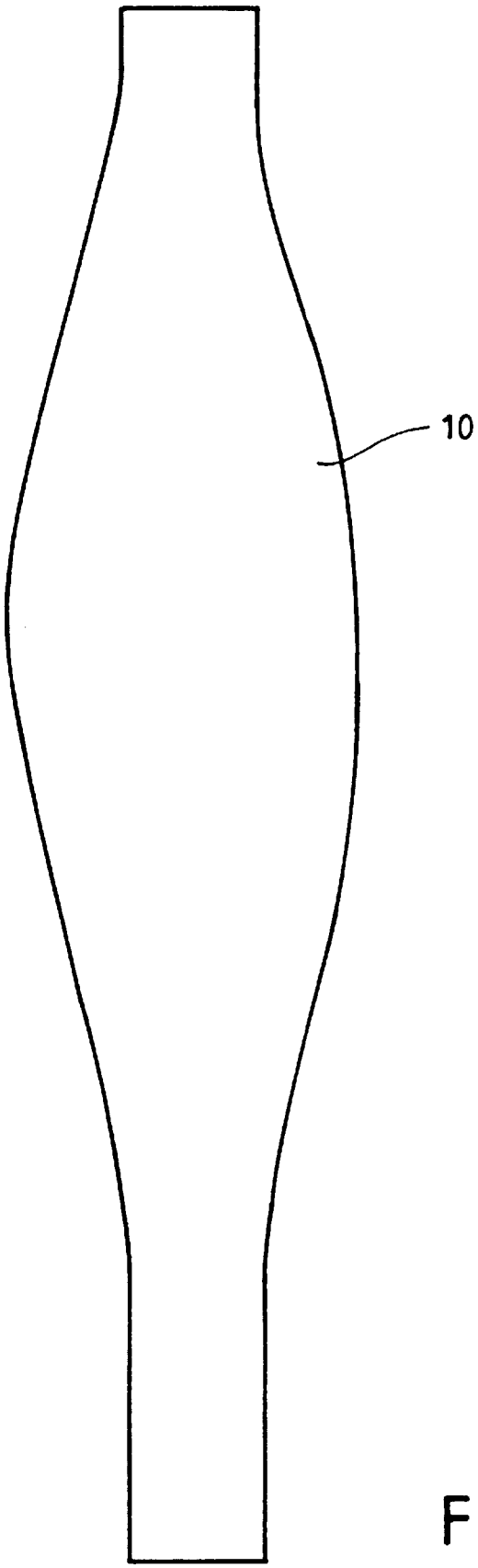
FIG. 1 is a plan view of a main part blank.

FIG. 1 shows in plan view a main part blank 10. Its upper and its lower end have in this case the same width whilst its middle part is widened with respect to the latter, but which may have any other desired shape. The upper and the lower end of the blank 10 serves at 12 to connect a gas generator. A ring-shaped main part materializes.

Figure 2:
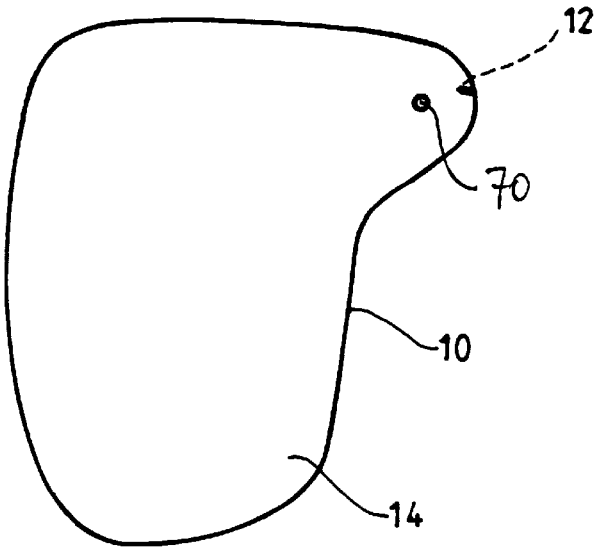
FIG. 2 is a side view of the main part blank brought into its final shape and a front view of a side plate blank.
Figure 3:
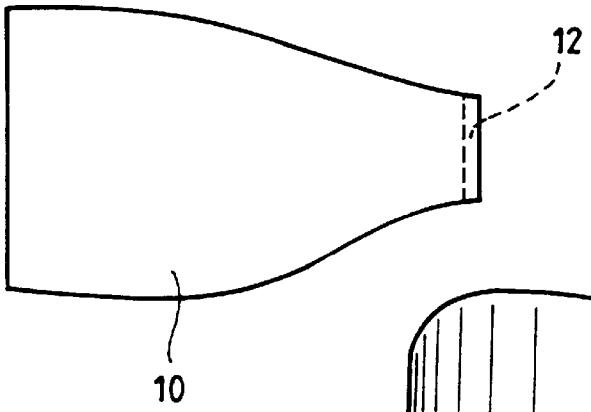
FIG. 3 is a plan view of the main part blank as seen from above in FIG. 2.
Figure 4:
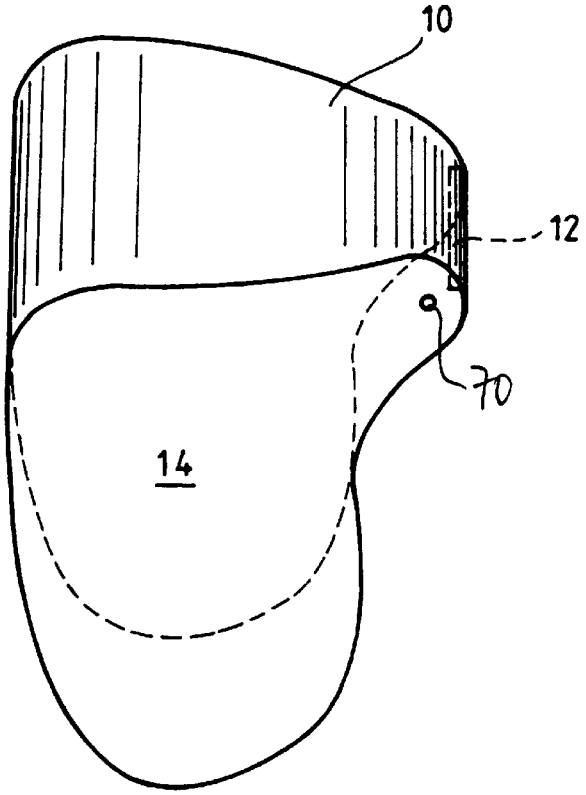
FIG. 4 is a perspective illustration of the main part blank and the front side plate blank.

FIG. 2 shows a typical shape of the main part blank 10 after it has become self-enclosed by curving. FIG. 3 shows the same main part blank 10 in a plan view (corresponding to FIG. 2 as seen from above). FIG. 4 shows the main part blank in perspective. The FIGS. 2 and 4 show further the front side part blank 14.

Figure 5:
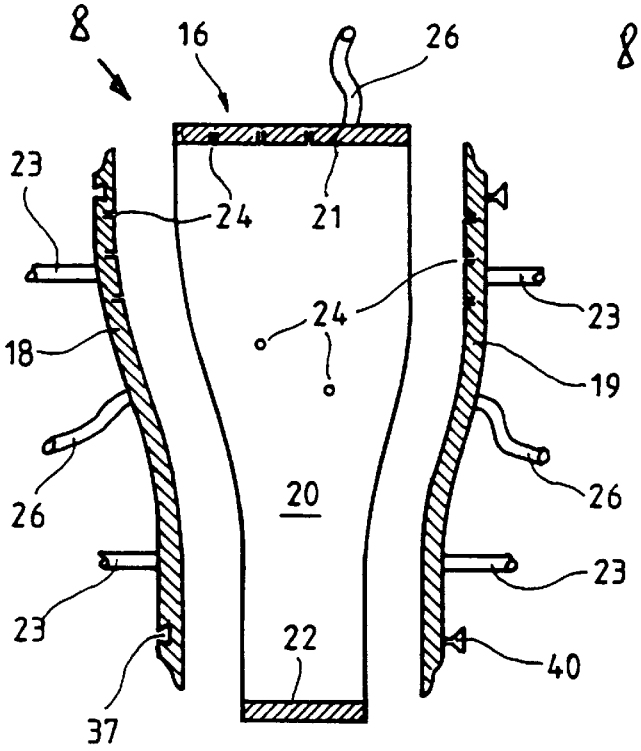
FIG. 5 shows the main part of a movement device in section along the line A—A in FIG. 6 as well as two side plates in perpendicular section.
Figure 6:
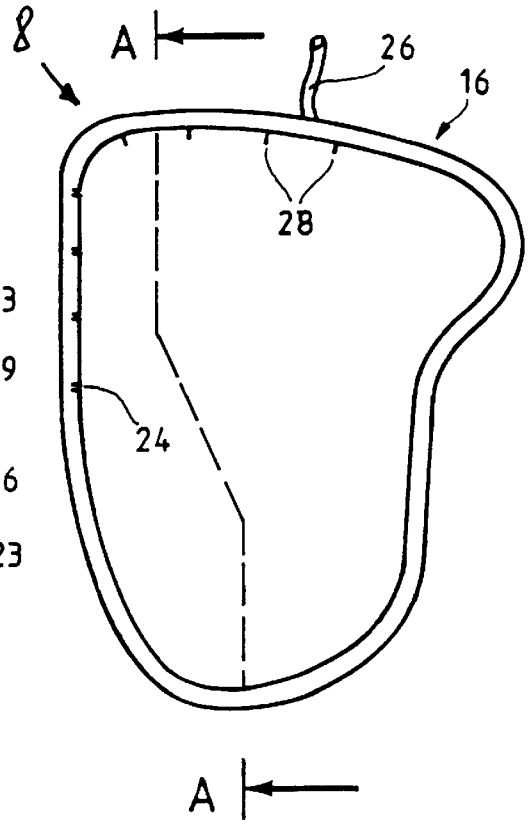
FIG. 6 is a side view of the main part of the movement device as seen from the left in FIG. 5, without the side plates.

FIGS. 5 and 6 show, greatly schematicized, an apparatus for holding and stitching the three blanks. A mounting device 8 has a main part 16 and two side plates 18, 19. The main part 16 is a cylinder, but not a circular cylinder, i.e. its internal surface being made up of a whole series of straight lines, such as 21 and 22 in FIG. 5, each in parallel to the other. In turn, the main part 16 includes, distributed about its interior surfaces, suction orifices 24 of which only a few are illustrated in this case. In this case passages (not shown) lead from the suction orifices 24 to a suction conduit 26, the two side plates also having suction orifices 24 and a suction conduit 26 in each case.

At the inner rim of the main part and at the outer rim of the two side plates register means in the form of marks 28 or holes or sections are provided which in FIG. 6 is depicted only for the main part, but is intended to apply just the same for the two side plates in FIG. 5. These register means serve for orientation when locating the main part blank on the inner wall 20 of the main part 16 and the two side parts on the inner walls of the two side plates 18, 19, i.e. on the walls facing the main part. Registration may be implemented by machine or manually by an operator. For this purpose the side plates 18, 19 are initially distanced relatively far away from the main part so that facilitated access to the main part and the side plates is made possible. In the registration procedure the suction devices may be operated with low suction so that the blanks can still be shifted manually whilst having a certain tack. As soon as on all sides the registration marks 28 or the like of the main part and side plates agree with corresponding registration marks or the like printed on the blanks the suction devices are switched to the full strength provided so that the blanks are fixed in position.

The procedure may also be the same in the case of electrostatic suction action, namely low power electrically during registration and full power on completion of registration.

Figure 7:
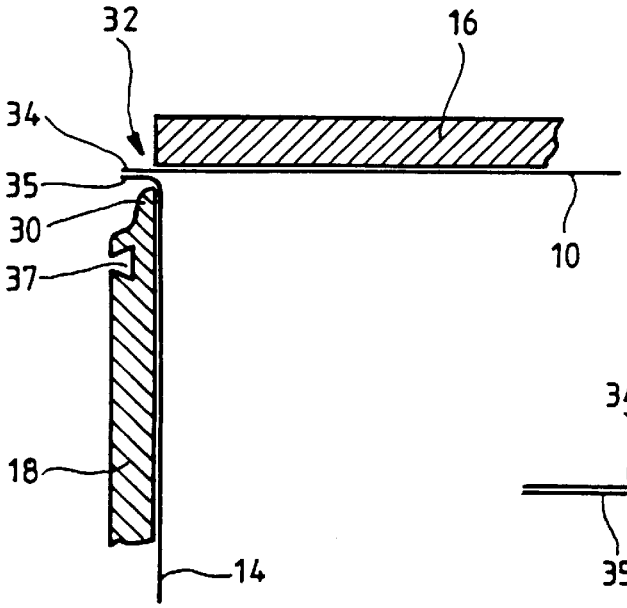
FIG. 7 is an illustration on a magnified scale of the left, upper corner of FIG. 5, but for a left-hand side plate advanced into the side plate.

The two side plates 18, 19 are then run over appendices 23 to the main part, i.e. sufficiently far so that their outer edges 30 (FIG. 7) locate just inside the inner outer edges 32 of the main part 16. The spacing remaining on all sides between the outer edges 30 and 32 amounts to slightly more than twice the thickness of the blanks 10 and 14. FIG. 7 shows at the top left in detail that the outer edge of the left-hand side part blank 14 has located itself into the outer edge of main part blank 10 protruding to the left. The freedom of movement between sewing machine and material hold is dictated by the type of stitching and the sewing machine.

The two protruding seam allowances 34, 35 are then automatically stitched to each other. This is done according to one of three different variants.

According to the first variant a relatively small automatic stitcher, known as such, is guided e.g. in a dovetail-shaped groove 37. This groove is provided close to the rim of the side plate 18 and is self-contained, i.e. it running around the complete side plate 18, as well as the side plate 19. Instead of grooves, rails 40 protruding outwardly may be provided as is illustrated in the case of the side plate 19 shown in FIG. 5. Also these rails 40 run around the side plates equally spaced away from their rim. Instead of this, guides 42 in the form a groove or rail may be arranged on both rims of the main part.

The side plates 18, 19 may be actuated manually and/or by an automatic moving apparatus in the one or in both directions with respect to the main part 16. An automatic moving apparatus may be combined with the two automatic stitchers. As soon as the side plates equipped with the suction-located blanks have been run to the rim of the main part 16, both stitchers are automatically set in operation, they running around the side plates or the main part in a groove or rail. Once they have attained their end, a change is automatically made so that the stitchers come to a standstill, after which the suction devices at the main part 16 and at the side plates 18 and 19 are switched off prior to the side plates being retracted from the main part. The air bag hollow body produced by the stitching is then located, collapsed, in the main part and can be extracted manually.

According to a second variant, instead of the running-around stitchers a sewing machine is provided, the stitching position of which is fixed in location and with respect to which the main part and side plates are moved, again also in combination with the movement device for advancing and retracting the side plates with respect to the main part.

The third variant differs from the second by the stitching location of the sewing machine being horizontally movable so that the stitching point is able to follow the uneven side rims of the main part when the latter turns.

Figure 8:
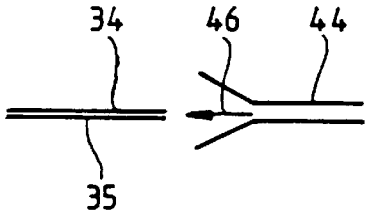
FIG. 8 is an illustration in principle of an inserter of a stitcher for seam allowances.

For reliable and precise introduction of the seam allowances 34 and 35 in the stitchers or sewing machine they may be provided with inserters 44. FIG. 8 shows the inserters 44 as seen from the left in FIG. 7 in a plane at right angles to that of FIG. 7. The inserters move in the direction of arrow 46 with respect to the seam allowances 34, 35.

The blanks for the main and side parts may be handled in the known way. Thus, flame retardancy reinforcements may be stitched in place where later the gas generator is intended to be located. Additive parts such as catch tapes may be stitched in place.

An air bag hollow body may be further processed by known ways and means. It may be turned inside out so that the seam allowances are then located on the inside. Parts for holding the gas generator may be applied. The hollow body is checked by known ways and means before it is finally connected to the gas generator and packaged together therwith.

Figure 9:
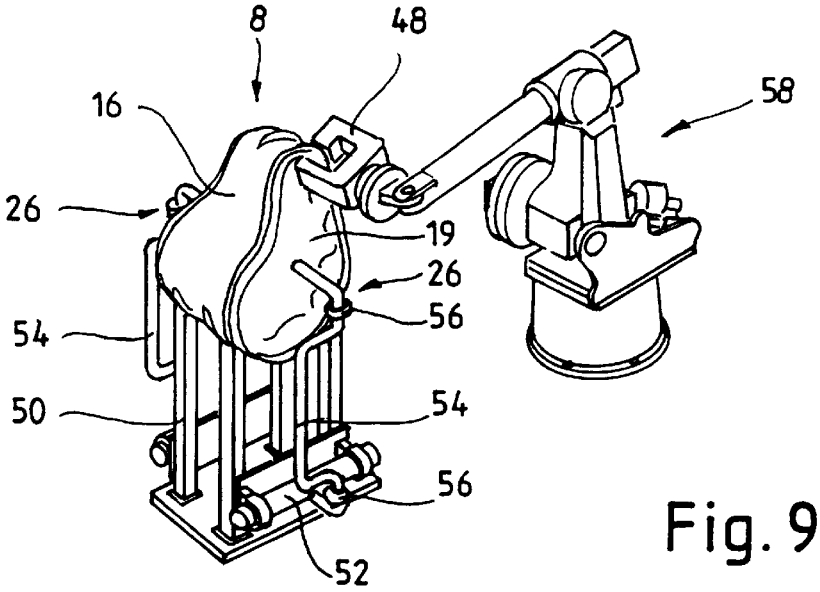
FIG. 9 shows in perspective a mounting device fixed in location including two closed side plates as well as a robotic device fixed in location for guiding an automatic stitcher around a rim of the apparatus.
Figure 10:
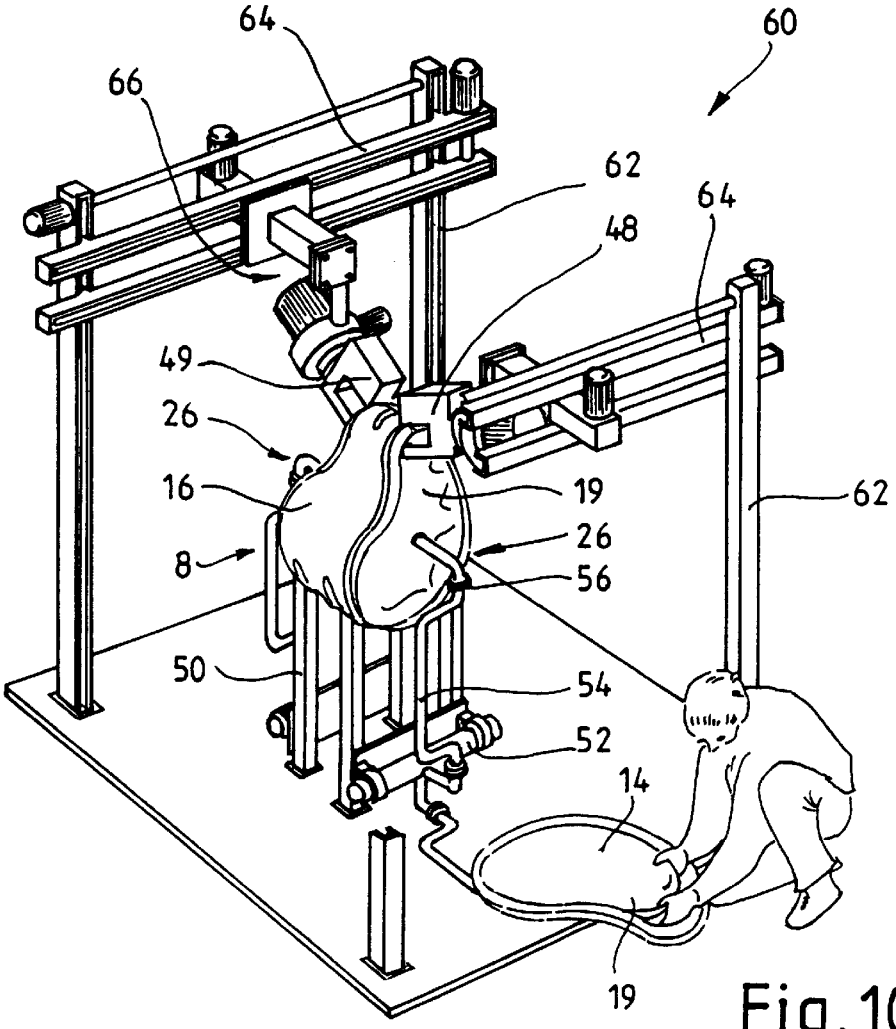
FIG. 10 shows in perspective within a portal robotic device which guides two automatic stitchers, a mounting device fixed in location including two closed side plates; the one side plate being, however, still in a second position, namely down-hinged.

FIGS. 9 and 10 show the guidance of an automatic stitcher 48 and of two stitchers 48, 49 respectively with the aid on one or two robotic devices: in both cases the main part 16 of the mounting device 8 is attached fixed in location on supports 50. In each case the main part has a suction conduit (not shown). The front side plate 19 and the rear side plate (in this case hardly discernible) are each connected to a suction conduit 26. With the aid of the suction conduits the side plates are openable outwardly and swivable downwardly, each of their lower ends being connected for this purpose to a horizontal rotatably mounted shaft 52.

In the course of each of the suction conduits 26 a tube 54 swivable about a perpendicular axis is provided. This tube is bulged in shape and is swivable thru approx. 180° in air-tight joints 56. If a flexible tube is arranged in the tube the joints need not be configured air-tight.

As shown in FIG. 9, during stitching the automatic stitcher 48 is guided by a robotic device 58 along and around the rim of the main part 16 and of the side plate 19. As illustrated in this case the stitching action starts at the bottom, the stitcher 48 having been located within the bulge, i.e. to the right of the tube 54. Whilst the stitcher runs around counter-clockwise the tube 54 is swivelled thru approx. 180° so that the stitcher at the end of running around enters into the bulge of the tube 54 from the left, it thus then having executed a full run around. Subsequently, the stitcher is brought by the robotic device 58 to the other (rear) side of the mounting device where it is run around in the same way. Instead of this, two robotic devices 58 may be provided, both working at the same time, the one at the front, the other at the rear side of the mounting device.

FIG. 10 shows the arrangement of two stitchers 48, 49 in a portal robotic device. On the perpendicular supports 62 horizontal rails 64 are arranged for perpendicular movement, on which the robotic device parts 66 are applied horizontally shiftable. These are inherently swivable and each carries one of the stitchers 48, 49. The running around and stitching procedure corresponds to that described on the basis of FIG. 9. FIG. 10 shows at the front a side plate 19 which can be hinged down on a base support 68. In this illustration a side part blank 14 is just being located. The mounting device 8 may also be arranged higher than shown in FIG. 10 so that the hinged-down side plates can be handled seated or standing.

Instead of in. a portal arrangement as shown in FIG. 10 the two stitchers 48, 49 may be run around by robotic parts within circular rails arranged like a gyro-wheel, but fixed in location, the mounting device 8 then being accommodated in the middle of the circular rails.

The finished hollow body may be tested prior to opening the mounting device 8 as to whether the seams have been produced satisfactorily on all sides. For this purpose air in blown into the interior of the hollow body by a compressed air conduit (not shown) and a test is made as to how quickly the pressure drops. The compressed air conduit may lead e.g. to an orifice illustrated in FIG. 2 and 4 which serves for application of a gas generator. Prior to stitching it can then be assured by a compressed air supply that the seam allowances 34, 35 (FIG. 7) register one on the other.

I claim:

1. An apparatus for fabricating a hollow body from blanks, obtained from at least one web of material comprising:

a) a main part in the form of a ring-like, self-contained plate, b) two side plates, the contours of which match those of the main part, and c) suction orifices distributed over inner walls of the main part and the side plates, said suction orifices being connected to at least one suction device for firmly holding, by suction, blanks disposed on said inner walls.

2. The apparatus as set forth in claim 1, wherein the inner walls of said main part and of said side plates are operatively coupled to an electrostatic generator for being electrostatically charged for attracting and firmly holding the blanks.

3. The apparatus as set forth in claim 1, wherein a movement device is provided which is actuatable at least one of by hand and automatically and which serves to guide each of said side plates from a position disposed outwardly from said main part into a position in which outer edges thereof are disposed within an inner edge of a side rim of said main part and back outwardly again.

4. The apparatus as set forth in claim 1, wherein a guide for an automatic stitcher is defined at least one of (1) along outer sides of and adjacent a periphery of said side plates and (2) at an outer side of and adjacent rims of said main part.

5. The apparatus as set forth in claim 4, wherein said guide is a dovetail-shaped groove.

6. The apparatus as set forth in claim 4, wherein said guide is a dovetail-shaped rail.

7. The apparatus as set forth in claim 1, wherein a) a sewing machine having a stitching point is provided, and b) said main part and side plates are movable in common with respect to the stitching point in a direction of a seam to be produced by said sewing machine.

8. The apparatus as set forth in claim 7, wherein said sewing machine and said at least one suction device are operatively coupled to a control device for sequential operation.

9. The apparatus as set forth in claim 1, wherein for precise registration of the blanks on the inner wall of the main part and on the inner walls of said side plates, registration indicia are provided on rims of at least one of the main part, the side plates and the blanks.

10. The apparatus as set forth in claim 1, wherein a single automatic stitcher is attached to a robotic device arm mounted fixed in location such that for fabricating at least one seam, it is guided around a rim of one of said side plates and then around a rim of the other of said side plates.

11. The apparatus as set forth in claim 1, wherein two automatic stitchers are attached to robotic parts guided horizontally and vertically such that for fabricating at least one seam, they are guided around a respective rim of each of said side plates.

12. The apparatus as set forth in claim 1, wherein at least one automatic stitcher is attached to a respective robotic device that is guided reciprocatingly in a circle within a circular ring-shaped guide that is fixed in location.

13. The apparatus as set forth in claim 1, wherein a) said main part is fixed in location and provided with a first suction conduit, b) second and third suction conduits extend, respectively, outwards from said side plate and also serve for swiveling said side plates in and out of said main part, c) said suction conduits of said side plates each including a tube, which in the vicinity of a rim of said side plate includes a bulge section for accommodating a stitching device and d) said bulge section is rotatable through about 180° such that said bulge section enables said stitching device to travel around along the entire side plate rim.

14. The apparatus as set forth in claim 1, further comprising a sewing machine mounted so as to be shiftable in at least one plane with respect to said main part and said side plates, said sewing machine having a stitching point, said main part and said side plates being movable in common with respect to the stitching point, whereby the stitching point can follow side rims of said main part as said main part is turned relative to said sewing machine.

15. A method for fabricating a hollow body from blanks obtained from a web of material, comprising:

providing an apparatus for fabricating a hollow body, said apparatus including a main part in the form of a ring-like, self-contained plate, and two side plates, the contours of which generally correspond to those of the main part, providing a main part blank generally corresponding in shape to an inner wall of said main part but wider than said inner wall to define a seam allowance, placing said main part blank on said inner wall of said main part and firmly holding said main part blank in place by at least one of a suction force and an electrostatic force, providing two side part blanks generally corresponding in shape to inner walls of said side plates but larger than said side plates by one seam allowance on all sides thereof, placing said side part blanks on said inner walls of said side parts and firmly holding said side plate blanks in place by at least one of a suction force an electrostatic force, guiding each of said side plates up to a rim of said main part so that said seam allowances of said side plate blanks firmly held in place at said side plates surroundingly locate at an inner side of said seam allowance of said main part blank firmly held at said main part, stitching said seam allowance of said main part blank to said seam allowances of said side port blanks to form a hollow body, and discontinuing said at least one of said suction force and electrostatic force and retracting at least one of said side plates from said main part and extracting the hollow body.

16. The method as set forth in claim 15, wherein said blanks are placed on said main part and said side plates using registration indicia provided thereon.

17. The method as set forth in claim 15, wherein after said stitching step to form said hollow body, compressed air is blown into the hollow body within the assembled main and side parts to test seams produced by said stitching step.

* * * * *